US005435400A

United States Patent [19]

Smith

[11] Patent Number: 5,435,400

[45] Date of Patent: Jul. 25, 1995

[54] LATERAL WELL DRILLING

[75] Inventor: Michael B. Smith, Lake Forest, Calif.

[73] Assignee: Atlantic Richfield Company, Los Angeles, Calif.

[21] Appl. No.: 248,972

[22] Filed: May 25, 1994

[51] Int. Cl.[6] ..... E21B 7/04; E21B 19/00

[52] U.S. Cl. ..... 175/61; 175/80; 166/384; 166/50; 166/117.6

[58] Field of Search ..... 175/61, 80, 81; 166/50, 166/77, 117.5, 117.6, 384

[56] References Cited

U.S. PATENT DOCUMENTS

| | | | |
|---|---|---|---|
| 2,173,035 | 9/1939 | Armentrout et al. | 175/61 X |
| 3,289,760 | 12/1966 | Kammerer | 166/55.8 X |
| 4,397,360 | 8/1983 | Schmidt | 175/80 X |
| 4,852,666 | 8/1989 | Brunet et al. | 175/61 |
| 5,052,502 | 10/1991 | Jurgens et al. | 175/80 |
| 5,154,231 | 10/1992 | Bailey et al. | 166/117.6 X |
| 5,195,591 | 3/1993 | Blount et al. | 166/117.5 X |
| 5,211,715 | 5/1993 | Braden et al. | 166/117.5 X |
| 5,215,151 | 6/1993 | Smith et al. | 175/61 X |
| 5,277,251 | 1/1994 | Blount et al. | 166/117.5 |
| 5,287,921 | 2/1994 | Blount et al. | 166/117.6 |

*Primary Examiner*—Roger J. Schoeppel
*Attorney, Agent, or Firm*—Roderick W. MacDonald

[57] ABSTRACT

A method for enhancing the productive capacity of a primary wellbore containing a conduit string such as casing involving removing at least a partial radial section of the casing to provide an aperture therein, setting tubing carrying a guide surface in the vicinity of the aperture and drilling a lateral wellbore at an angle to the primary wellbore using a coiled tubing conveyed drilling assembly.

15 Claims, 3 Drawing Sheets

LATERAL WELL DRILLING

BACKGROUND OF THE INVENTION

Heretofore horizontal wellbores, i.e., a wellbore that starts out essentially vertical and then curves into an essentially horizontal disposition, have been employed in order to achieve a more productive well.

There are a number of existing primary wellbores, both vertical in nature or deviated, whose productive capacity could be enhanced by drilling secondary or lateral wellbores therefrom.

This invention provides a timely and cost efficient method for enhancing the productive capacity of a primary wellbore, whether vertical or deviated, by providing a procedure by which one or more secondary wellbores are formed from the primary wellbore at one or more locations along that wellbore.

SUMMARY OF THE INVENTION

In accordance with this invention at least one aperture is formed in a conduit string, be it casing or tubing, that lines the wellbore after which a tubing string is set inside the conduit string, the tubing string carrying a guide surface at its distal end. Thereafter, a downhole drilling assembly is run into the tubing string by way of coiled tubing to engage with the guide surface and thereby direct the drilling assembly toward the aperture. Upon operation of the drilling assembly, a secondary (lateral) wellbore is formed which extends at an angle to the long axis of the primary wellbore.

Accordingly, it is an object of this invention to provide a new and improved method for enhancing the productive capacity of a primary wellbore. It is another object to provide a new and improved method for forming at least one secondary wellbore from an existing primary wellbore.

Other aspects, objects and advantages of this invention will be apparent to those skilled in the art from this disclosure and the appended claims.

DETAILED DESCRIPTION OF THE INVENTION

Figure 1:
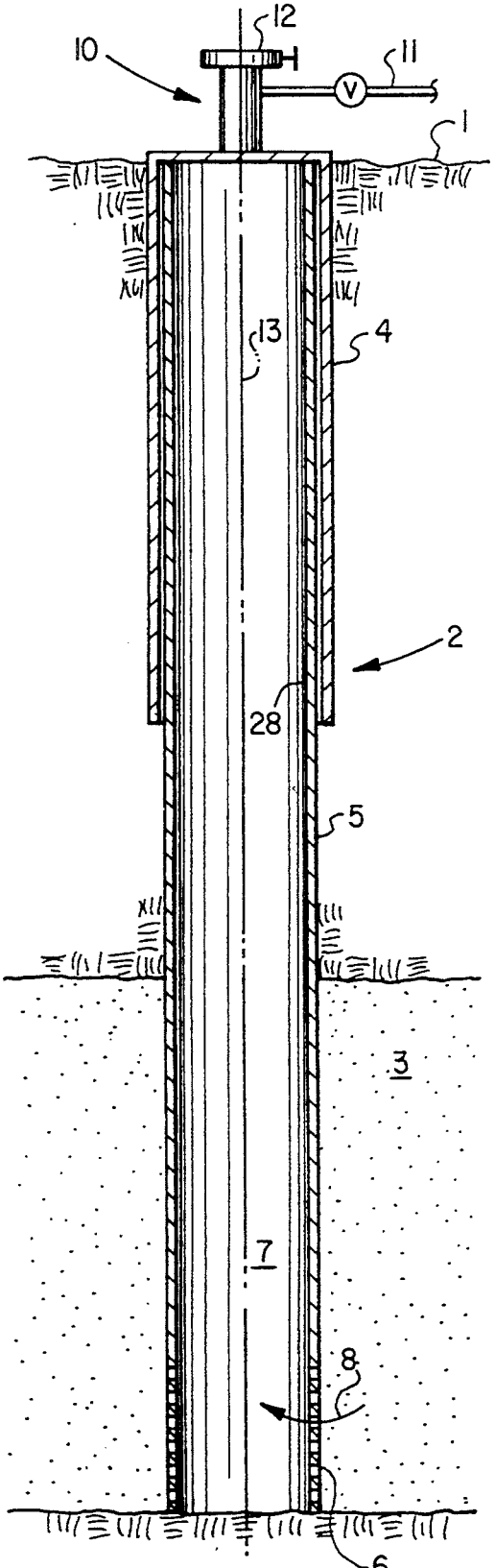
FIG. 1 shows a cross section of an existing primary wellbore.

FIG. 1 shows the earth's surface 1 with a primary wellbore 2 extending essentially vertically thereinto down to subsurface geologic formation 3 from which one or more minerals such as oil, natural gas, carbon dioxide, and the like is produced. The upper portion of wellbore 2 is lined with a metal conduit string 4 most commonly referred to as surface casing. The remainder of wellbore 2 is lined with a smaller diameter conduit string 5 which can be either metal casing or tubing, but is more often casing. The lower end of conduit string 5 is terminated with a slotted liner 6 through which fluid or fluidized minerals from formation 3 can flow into open internal space 7 of conduit string 5 as shown by arrow 8 for production to and recovery at earth's surface 1. Wellbore 2 is capped at earth's surface 1 by a conventional wellhead 10 which carries a valved line 11 for recovery of minerals at the earth's surface. Wellhead 10 is capped by a conventional crown valve 12. Primary wellbore 2 has a long axis 13 that extends into the earth and that is in alignment and coincides with the long axis of conduit string 5. The long axis of conduit string 5 can, therefore, also be represented by long axis 13. Internal space 7 of conduit string 5 extends along axis 13.

Figure 2:
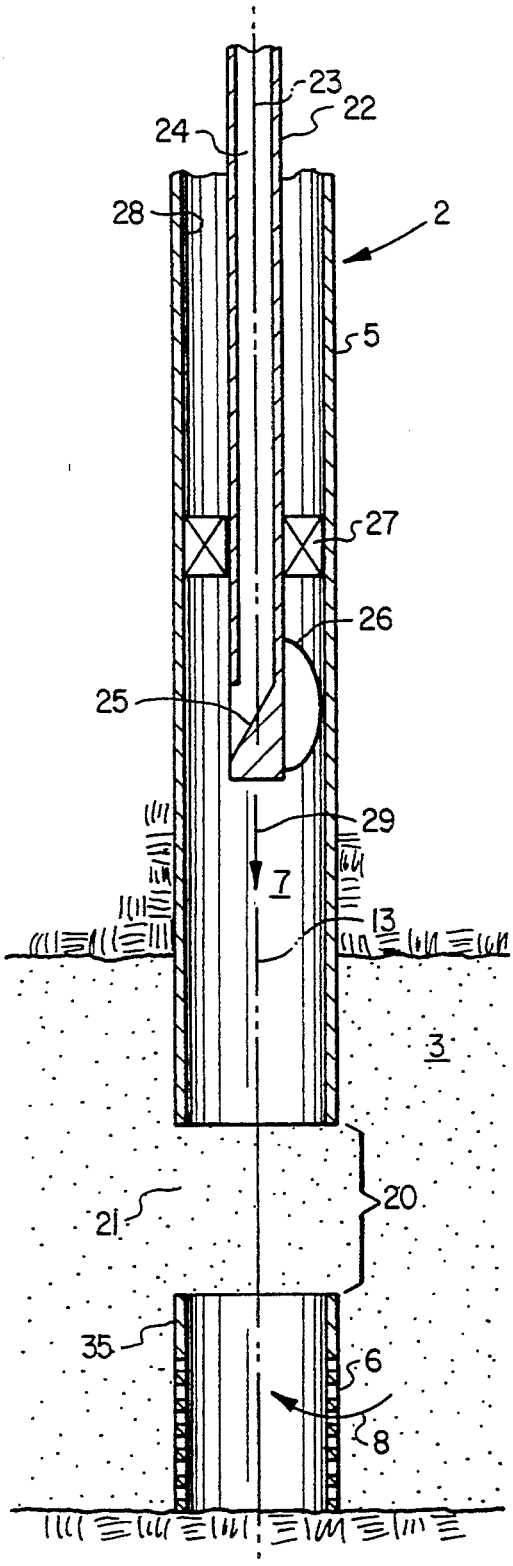
FIG. 2 shows the wellbore of FIG. 1 after an aperture has been formed therein and with a tubing-guide surface combination being inserted in the primary wellbore.

In accordance with this invention, as shown in FIG. 2, at least a partial radial section 20 is removed from conduit string 5 to form an aperture 21 therein. The embodiment of FIG. 2 totally separates lower portion 35 of conduit string 5 from the remaining upper portion of same, although total separation is not required in this invention. For example, aperture 21 can be just a window milled in conduit string 21 which leaves conduit string 5 in tact from top to bottom since a window would encompass substantially less than the 360 degree radius encompassed by aperture 21 of FIG. 2. Aperture 21 or a narrower window can extend any desired length along the long axis of conduit string 5 and can radially encompass less than the entire circumference of conduit string 5 in lieu of the full or entire circumference of conduit string 5 as shown in FIG. 2. Formation of aperture 21 provides substantially greater access to formation 3 for the subsequent production of greater quantities of mineral values into internal space 7.

After formation of aperture 21 a conventional tubing string 22 (jointed or coiled) is inserted into internal space 7 from earth's surface 1, tubing string 22 having a long axis 23 and an open internal space 24 along axis 23. Tubing string 22 carries at its distal end a guide surface 25, an optional centralizer 26, and optional packer 27. Packer 27 is expandable upon actuation (mechanically, electrically, or pressurization) to expand and seal with the interior surface 28 of conduit string 5. This integral tubing 22—guide surface 25 combination is lowered through internal space 7 as shown by arrow 29 until guide surface 25 is in the vicinity of aperture 21.

Figure 3:
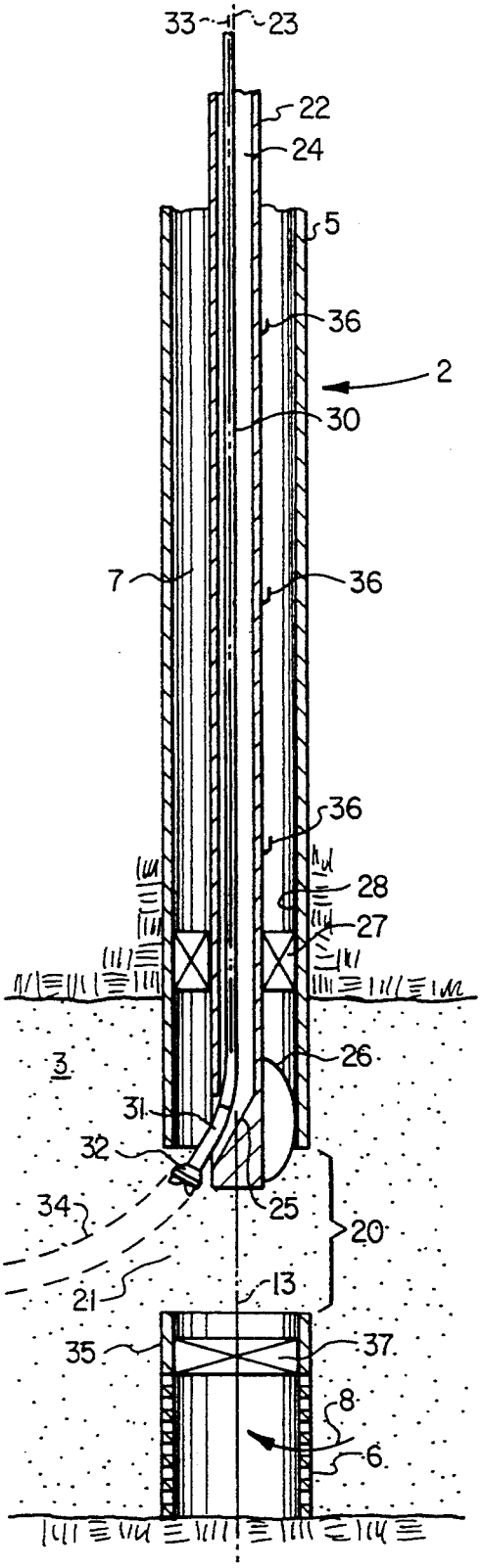
FIG. 3 shows the wellbore of FIG. 2 after the tubing-guide surface combination has been set in place and a downhole motor-bit assembly inserted into the interior of the tubing by way of a coiled tubing string.
Figure 7:
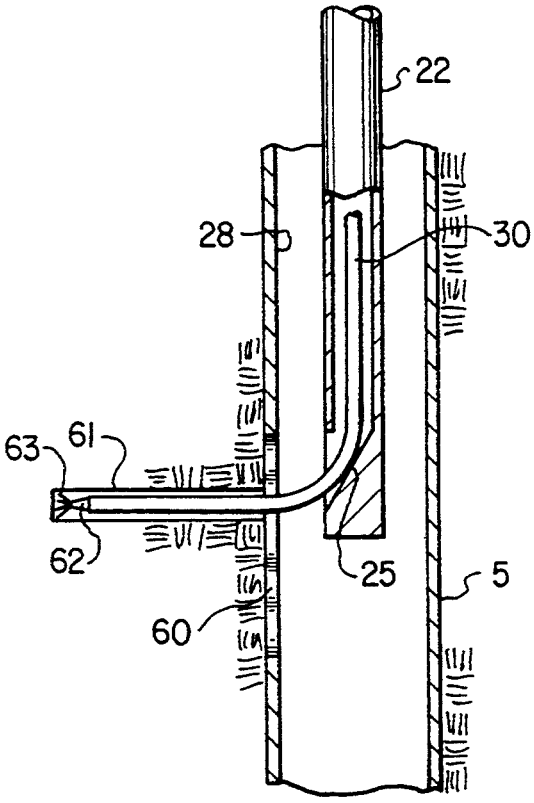
FIG. 7 shows a jet drilling assembly useful in this invention.

Normally guide surface 25 will be essentially adjacent to aperture 21 as shown in FIGS. 3 and 7. Guide surface 25 is oriented toward a portion of aperture 21 through which a secondary wellbore is desirably drilled. The orientation of guide surface 25 can be accomplished at any time. For example, the orientation can be established at the earth's surface before tubing string 22 is inserted into internal space 7. However, guide surface 25 can be oriented by simple rotation of tubing string 22 from the earth's surface while tubing 22 is passing downwardly (arrow 29) or after tubing 22 is set in place in internal space 7. Alternatively, tubing string 22 can carry a conventional indexing tool near guide surface 25, as explained in greater detail hereinafter with reference to FIG. 4, for rotating the guide surface by way of operation of the indexing tool downhole without rotating tubing string 22. Any approach well known in the art for orienting guide surface 25 can be employed in this invention essentially to point guide surface 25 toward the portion of aperture 21 where a secondary wellbore is to be formed.

FIG. 3 shows tubing string 22 set in place by means of expanded packer 27 in internal space 7 of conduit string 5 with guide surface 25 in the vicinity of aperture 21. Guide surface 25 in FIG. 3 is essentially adjacent to aperture 21 but in the practice of the invention guide surface 25 can be set further along the length 20 of aperture 21 so that it is clearly adjacent to aperture 21. Tubing string 22 can be set so that guide surface 25 is anywhere along the length of aperture 21 so long as the desired secondary wellbore can be drilled without impinging on the lower portion of 35 of conduit string 5.

Coiled tubing 30 carrying at its distal end a downhole motor 31—drill bit 32 combination is inserted into internal space 24 of tubing string 22. Coiled tubing 30 has a long axis 33 which is shown for sake of clarity in FIG. 3 as displaced from axis 23 of tubing string 22, but which can coincide with axis 23 in the same manner that the long axis of wellbore 2 coincides with the long axis of conduit string 5.

The downhole motor-bit combination is lowered by way of coiled tubing 30 until bit 32 engages guide surface 25 whereupon bit 32 is directed at an angle to axis 13 toward aperture 21. When downhole motor 31 is operated it causes bit 32 to form a secondary wellbore 34 which extends at an angle to long axis 13 of primary wellbore 2 and conduit string 5. Thus, it can be seen that by the method of this invention a secondary wellbore 34 can be drilled a substantial distance out into producing formation 3 thereby increasing substantially the access of internal space 7 to the interior of formation 3 separately from and in addition to the access provided by slotted liner 6.

Figure 8:
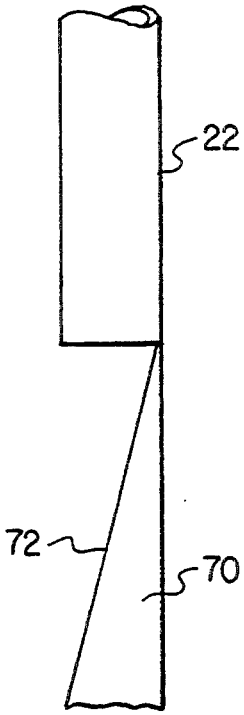
FIG. 8 shows an alternative guide surface embodiment.

Full circle aperture 21 can be formed by any conventional equipment know in the art for removing a section of conduit string such as well known casing cutters, underreamers, and the like. Similarly, secondary wellbore 34 can be drilled in any known manner. For example, instead of using a drill bit 32, secondary wellbore 34 can be drilled using high pressure jet nozzle drilling equipment conveyed to guide surface 25 and aperture 21 by way of coiled tubing 30 as shown in FIG. 7. Also, underbalanced drilling can be used in which case gas lift ports 36 are employed on tubing string 22 and a temporary plug 37 emplaced at the top of slotted liner 6 to stop the flow of fluids by way of arrow 8. Plug 37 can be a removable mechanical plug, cement plug, gel plug, or the like. Similarly, any conventional coiled tubing unit can be used to deploy coiled tubing 30, a suitable coiled tubing unit being fully and completely disclosed in U.S. Pat. No. 5,287,921 to Blount et at, the disclosure of which is incorporated herein by reference. Coiled tubing 30 can also be used to dispose a liner or other conventional well completion equipment into secondary wellbore 34 after its drilling has been completed. Guide surface 25 as shown in FIGS. 2 through 4, and 6 is integral with and internal to tubing string 22. A suitable guide surface can also be provided by carrying a conventional or modified whipstock at the end of tubing string 22 as shown in FIG. 8. The normally slanted surface 72 of the whipstock serves as guide surface 25.

After secondary wellbore 34 is drilled, coiled tubing 30 can be removed from internal space 24 of tubing string 22 or at least pulled sufficiently up into internal space 24 so that guide surface 25 can be reoriented for the drilling of another secondary wellbore through the same aperture 21. As noted above reorientation of guide surface 25 can be accomplished by rotation of all or part of tubing string 22 at or below the earth's surface 1 or by rotating essentially only the guide surface portion of string 22 as described hereinafter with respect to FIG. 4.

Figure 4:
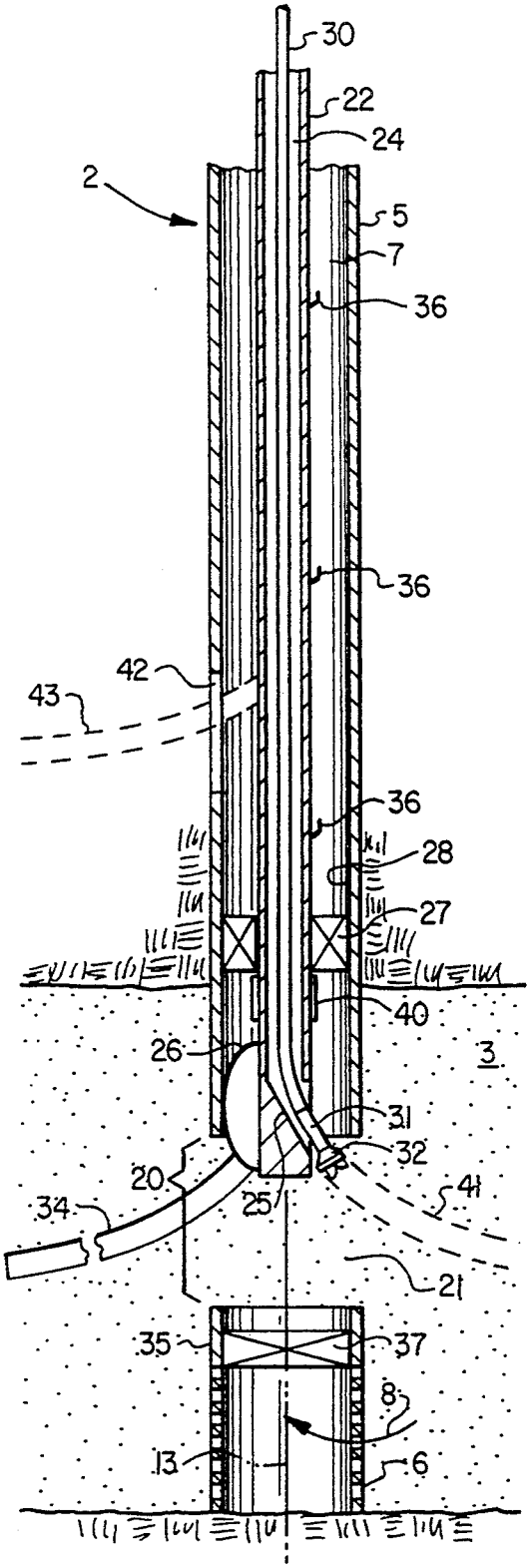
FIG. 4 shows the wellbore of FIG. 3 after a secondary wellbore has been drilled at a angle to the long axis of the primary wellbore and at the start of formation of another secondary wellbore.

FIG. 4 shows tubing string 24 carrying a conventional indexing tool 40 below packer 27 and above guide surface 25. Tool 40 can be actuated mechanically, electrically, or the like from the earth's surface to cause the portion of tubing string 22 below indexing tool 40 and containing guide surface 25 to rotate a predetermined number of degrees to reorient guide surface 25 towards a new portion of aperture 21 for drilling another secondary wellbore. The few degree rotation can be repeated as many times as necessary to achieve a proper orientation. In the case of FIG. 4, guide surface 25 has been rotated 180 degrees although this is not required. Indexing tool 40 is a conventional piece of apparatus well known in the art, one of which is disclosed under the term "orienting tool" in U.S. Pat. No. 5,215,151 to Smith et at, the disclosure of which is incorporated herein by reference.

Once guide surface 25 is rotated the desired number of degrees, downhole motor 31—drill bit 32 combination is redeployed by way of coiled tubing 30 in the manner described hereinabove with reference to FIG. 3. Thus, another secondary wellbore 41 is drilled at an angle to long axis 13 but in a totally different interior portion of formation 3. This further increases the access of internal space 7 to the interior of formation 3. This procedure can be repeated as many times as is reasonable for a single aperture. That is why a 360 degree radial aperture 21 is shown.

As noted above, an aperture useful in this invention can be a window in conduit string 5 that radially encompasses less than even substantially less than, the entire 360 degree circumference of conduit string 5. If less than the entire circumference of the conduit string is desired for the aperture of this invention, a window can be milled in the conduit string using various milling practices. For example, tubing string 22 with guide surface 25 can be used to direct a downhole motor-mill combination to the inner surface 28 of conduit string 5 so that the mill can form an aperture (window) of only a few degrees of radius instead of the 360 degree radius of aperture 21. Thereafter a secondary wellbore, e.g., wellbore 34 of FIG. 3, can be drilled through this narrow window in the same manner disclosed in FIG. 3 above. Other window milling equipment can be employed such as that described in U.S. Pat. No. 5,277,251 to Blount et al, the disclosure of which is hereby incorporated by reference.

If additional secondary wellbores are desired along the length of wellbore 2 and conduit string 5, a second spaced apart aperture 42 can be milled or cut in conduit string 5 after which 1 or more secondary wellbores 43 can be drilled therethrough in the manner disclosed with reference to FIG. 3 hereinabove. Thus, more than 1 aperture can be formed along the long axis 13 of conduit string 5 so that secondary wellbores can be formed spaced apart along the length of conduit string 5 at as many locations as desired and reasonable. Thus, the productive capacity of wellbore 2 can be enhanced not only from formation 3 but also from other formations along the length of wellbore 2 that are removed from and not connected with formation 3.

Figure 5:
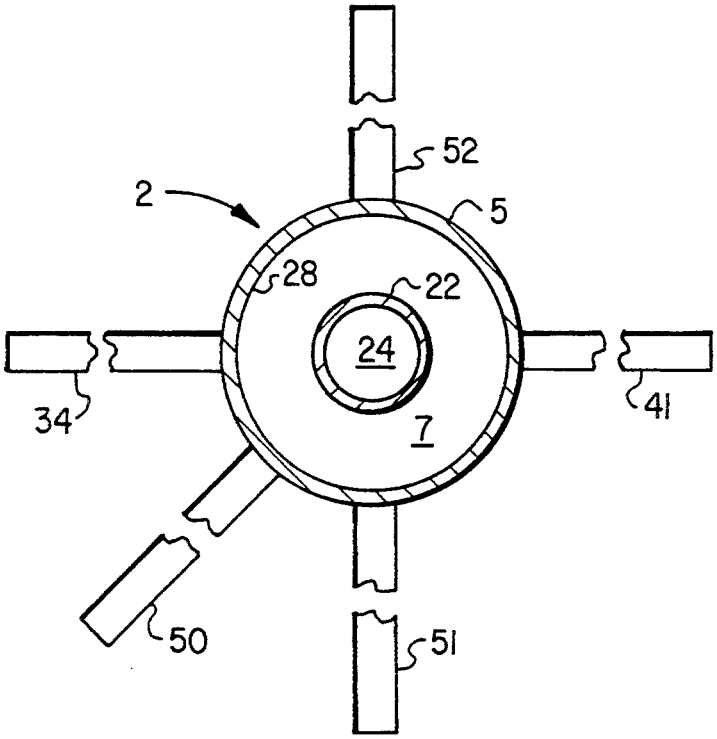
FIG. 5 shows a top view of a primary wellbore from which five secondary wellbores have been drilled.

FIG. 5 shows a top view of wellbore 2 wherein, in addition to secondary wellbores 34 and 41 of FIGS. 3 and 4 hereinabove, additional spaced apart secondary wellbores 50, 51, and 52 are shown to have been drilled from aperture 21. Any number of spaced apart secondary wellbores radially around wellbore 2 and, by way of additional spaced apart apertures, at various locations along the length of wellbore 2 can be achieved by this invention.

Figure 6:
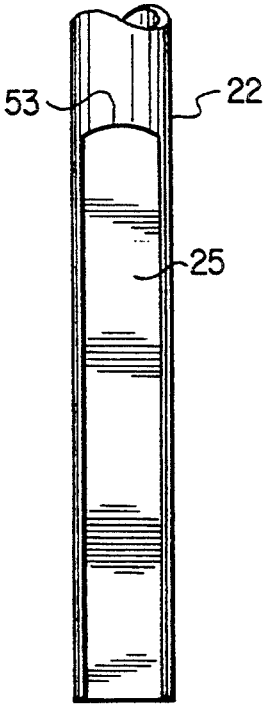
FIG. 6 shows a front view of a guide surface useful in this invention.

FIG. 6 shows what the wellbore 34 portion of aperture 21 would see of guide surface 25 before drilling wellbore 34. FIG. 6 shows guide surface 25 to be a flat surface contained within the interior walls of tubing string 22 and facing an elongate opening 53 which will allow bit 32 followed by downhole motor 31 and coiled tubing 30 to exit from internal space 24 of tubing 22 to meet and drill the portion of formation 3 that faces guide surface 25. As noted above, instead of the apparatus of FIG. 6, a conventional whipstock such as that shown in U.S. Pat. No. 5,277,251 to Blount et at, can be used.

FIG. 7 shows conduit string 5 having a narrow window (aperture) 60 of substantially less than the 360 degree radius of aperture 21, but still wide enough to pass a drilling assembly therethrough to form a secondary wellbore 61. In this case, instead of using a motor-bit assembly, a high pressure jet drilling nozzle 62 is employed at the distal end of coiled tubing 30, wellbore 61 being formed by high pressure fluid 63 being supplied from the earth's surface through the interior of tubing 30 and emitted by nozzle 62 at a high velocity and pressure.

FIG. 8 shows tubing string 22 carrying at its distal end whipstock 70 whose normal guide surface 72 can serve as a substitute for guide surface 25.

As an example, a primary wellbore essentially as shown in FIG. 1 is completed with 9⅝" diameter steel casing for conduit string 5 and a 6⅝" diameter slotted steel liner for liner 6 and produces 100 barrels of oil per day and 50 barrels of water per day by way of arrow 8. The casing is sectioned as shown in FIG. 3 using an underreamer and cement for temporary plug 37. A string of jointed 4½" diameter steel tubing is used for tubing string 22. Two inch diameter coiled tubing is employed for coiled tubing 30 using a conventional whipstock to provide guide surface 25. The 4½" tubing string is rotated with conventional equipment at the earth's surface to reorient the whipstock after the first, lateral well 34 is drilled.

Reasonable variations and modifications are possible within the scope of this disclosure without departing from the spirit and scope of this invention.

What is claimed is:

1. In a method for enhancing the productive capacity of a primary wellbore, said wellbore having a long axis and extending into the earth along said well bore long axis, said wellbore containing at least one conduit string which has a long axis essentially in alignment with the long axis of said wellbore, said conduit string having an internal space along its long axis, the improvement comprising removing at least a partial radial section of said conduit string to provide an aperture therein, providing a tubing string having a long axis and an internal space along said tubing string long axis, said tubing string supporting a guide surface at its distal end, setting said tubing string in the internal space of said conduit string with no additional support for said guide surface which is located below said guide surface within said conduit string so that said guide surface is suspended in the vicinity of said aperture and oriented toward at least a portion of said aperture, providing coiled tubing having a drilling assembly on the distal end thereof, passing said coiled tubing and drilling assembly through the internal space of said tubing string to engage said drilling assembly with said guide surface and direct said drilling assembly toward said aperture portion at an angle to the long axis of said wellbore, and operating said drilling assembly to form a secondary wellbore which extends at an angle to the long axis of said wellbore.

2. The invention set forth in claim 1 wherein:
said aperture radially encompasses less than the entire circumference of said conduit string.

3. The invention set forth in claim 1 wherein:
said aperture radially encompasses the full circumference of said conduit string.

4. The invention set forth in claim 1 wherein:
said guide surface is carried internally of said tubing string.

5. The invention set forth in claim 1 wherein:
said guide surface is carried by a whipstock and said whipstock is carried by said tubing string.

6. The invention set forth in claim 1 wherein:
said tubing string is set in said conduit string so that said guide surface is essentially adjacent to said aperture.

7. The invention set forth in claim 1 wherein:
said tubing string is rotated to orient said guide surface.

8. The invention set forth in claim 7 wherein:
said tubing string is rotated at the earth's surface.

9. The invention set forth in claim 1 wherein:
said tubing string carries an indexing tool near said guide surface, and said guide surface is rotated for orientation by operation of said indexing tool.

10. The invention set forth in claim 1 wherein:
more than one secondary wellbore is drilled through said aperture.

11. The invention set forth in claim 1 wherein:
a plurality of spaced apart secondary wellbores are drilled through at least one aperture.

12. The invention set forth in claim 1 wherein:
more than one aperture is formed along the long axis of said conduit string so that secondary wellbores can be formed spaced apart along said long axis.

13. The invention set forth in claim 1 wherein:
said aperture is formed using said tubing string carrying a guide surface on its distal end.

14. The invention set forth in claim 1 wherein:
said drilling assembly is a downhole motor and drill bit combination.

15. The invention set forth in claim 1 wherein:
said drilling assembly is a jet drilling device.

* * * * *

US005435400B1

REEXAMINATION CERTIFICATE (3773rd)

United States Patent [19] [11] B1 5,435,400

Smith [45] Certificate Issued Jun. 1, 1999

[54] LATERAL WELL DRILLING

[75] Inventor: Michael B. Smith, Lake Forest, Calif.

[73] Assignee: Atlantic Richfield Company, Plano, Tex.

Reexamination Request:
No. 90/004,896, Jan. 16, 1998

Reexamination Certificate for:

| | |
|---|---|
| Patent No.: | **5,435,400** |
| Issued: | **Jul. 25, 1995** |
| Appl. No.: | **08/248,972** |
| Filed: | **May 25, 1994** |

[51] Int. Cl.[6] ..... E21B 7/04; E21B 19/00

[52] U.S. Cl. ..... 175/61; 175/80; 166/384; 166/50; 166/117.6

[58] Field of Search ..... 166/50, 77.2, 85.5, 166/384; 125/61, 62, 80, 81; 175/82, 83, 320

[56] References Cited

U.S. PATENT DOCUMENTS 2,386,514 10/1945 Stokes ..... 175/82 X
2,699,920 1/1955 Zublin ..... 175/83 X
5,115,872 5/1992 Brunet et al. .

OTHER PUBLICATIONS

Gardes, Robert A, New Radial Drilling Technology Applied to Recovering Cores, The American Oil & Gas Reporter, Apr. 23, 1993.

Excerpt, The American Oil & Gas Reporter, Jul. 1991.

Excerpt, Improved Recovery Week, Jul. 6, 1992.

Excerpt, Offshore, Jul. 1989.

Excerpt, Petroleum Engineer International, Jun. 1994.

Excerpt, Oil and Gas Journal, Feb. 26, 1990.

*Primary Examiner*—Roger Schoeppel

[57] ABSTRACT

A method for enhancing the productive capacity of a primary wellbore containing a conduit string such as casing involving removing at least a partial radial section of the casing to provide an aperture therein, setting tubing carrying a guide surface in the vicinity of the aperture and drilling a lateral wellbore at an angle to the primary wellbore using a coiled tubing conveyed drilling assembly.

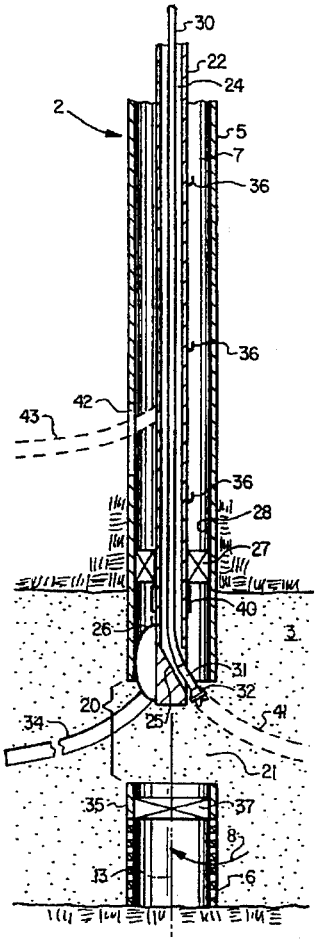

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 13 is cancelled.

Claim 1 is determined to be patentable as amended.

Claims 2–12, 14 and 15, dependent on an amended claim, are determined to be patentable.

1. In a method for enhancing the productive capacity of a primary wellbore, said wellbore having a long axis and extending into the earth along said well bore long axis, said wellbore containing at least one conduit string which has a long axis essentially in alignment with the long axis of said wellbore, said conduit string having an internal space along its long axis, the improvement comprising removing at least a partial radial section of said conduit string to provide an aperture therein, providing a tubing string having a long axis and an internal space along said tubing string long axis, said tubing string supporting a guide surface at its distal end, setting said tubing string in the internal space of said conduit string with no additional support for said guide surface which is located below said guide surface within said conduit string so that said guide surface is suspended in the vicinity of said aperture and oriented towards at least a portion of said aperture, providing coiled tubing having a drilling assembly on the distal end thereof, passing said coiled tubing and drilling assembly through the internal space of said tubing string to engage said drilling assembly with said guide surface and direct said drilling assembly toward said aperture portion at an angle to the long axis of said wellbore, and operating said drilling assembly to form a secondary wellbore which extends at an angle to the long axis of said wellbore *wherein said aperture is formed using said tubing string carrying said guide surface on its distal end.*

* * * * *